United States Patent [19]

Wilten

[11] 4,310,976

[45] Jan. 19, 1982

[54] PICTURE DISPLAY DEVICE

[76] Inventor: Stanley M. Wilten, 2145 Sandy Shore, S.E., Grand Rapids, Mich. 49506

[21] Appl. No.: 87,700

[22] Filed: Oct. 24, 1979

[51] Int. Cl.[3] ..... G09F 1/12

[52] U.S. Cl. ..... 40/152.1; 40/10 D

[58] Field of Search ..... 40/160, 10 D, 152, 152.2, 40/546, 152.1

[56] References Cited

U.S. PATENT DOCUMENTS

| | | | |
|---|---|---|---|
| 1,778,636 | 10/1930 | Herbert | 40/152.1 |
| 1,807,288 | 5/1931 | Herbert | 40/152.1 |
| 1,809,786 | 6/1931 | Le Jeune | 40/152 |
| 2,598,755 | 6/1952 | Birch | 40/158 |
| 3,024,553 | 3/1962 | Rowley | 40/158 R |
| 3,919,797 | 11/1975 | Murajami | 40/538 |
| 4,161,834 | 7/1979 | Hendricks | 40/152.1 |
| 4,180,930 | 1/1980 | DiMatteo | 40/160 |
| 4,187,630 | 2/1980 | Giulie | 40/152 |
| 4,204,350 | 5/1980 | Brenner | 40/156 |

*Primary Examiner*—G. E. McNeill
*Assistant Examiner*—Wenceslao J. Contreras
*Attorney, Agent, or Firm*—Price, Heneveld, Huizenga & Cooper

[57] ABSTRACT

The specification discloses a picture display device comprising a pair of transparent panels interconnected in an aligned and overlying relationship for mounting variously sized pictures therebetween without a separate mat.

3 Claims, 5 Drawing Figures

PICTURE DISPLAY DEVICE

BACKGROUND OF THE INVENTION

The present invention relates to picture display devices. The term picture as used herein is intended to be very broad. It includes things such as photographs, paintings, press clippings, collages, pressed flowers, pressed butterflies, etc. In the mounting and/or framing of pictures, such as drawings, photographs, paintings, and the like, if the picture to be mounted is not sized precisely the same as the selected frame, a mat is typically provided behind the picture to fill in-between the edge of the frame and the outer, marginal edge of the picture with a plain background, so as to create a neat, attractive appearance. The mat is usually a plain sheet of material having an inobtrusive color, such that it will not detract from the appearance of the frame or cause the viewer to divert his focus from the picture. Some pictures are purposely "matted" in an attempt to improve their appearance in a particular setting.

The proper matting or framing of pictures is an art which requires a great deal of skill and patience. In order to obtain a neat, attractively mounted picture, the services of a professional in the framing art are usually required, thereby rendering picture framing a quite costly project. Further, current framing techniques provide mounting the picture in the frame in a semi-permanent manner, such that the reframing of the picture to accommodate a new setting is a very difficult and time consuming task.

Heretofore, frames have been developed which attempt to simplify the framing of pictures, particularly for relatively inexpensive frames into which current snapshots and/or photographs are temporarily mounted. One such device comprises a rectangularly-shaped housing, having a clear plastic front panel with integrally formed side walls, and a rectangular cardboard insert shaped for telescopic insertion into the housing. The insert includes a plain, single-colored front face on which a picture is centered and attached, and the insert and attached picture are then positioned into the transparent housing to mount the picture and form a frame therefor.

Another such device includes a first plastic member bent to define a stand and a second smaller plastic member with curled top and bottom edges adhered to the first to center and mount a picture in. However, the picture either has to be the same size as the second plastic member, or it has to be matted.

Such conventional framing devices have served well for years and look fine on conventional walls. However, they tend to look out of place on modern office room divider panels. Further, it is difficult to hang them on such panels since you cannot drive a nail or the like into the panel.

SUMMARY OF THE INVENTION

The present invention provides a picture display device comprising a pair of interconnected transparent panels adapted to neatly mount variously sized pictures therebetween without a separate mat. This invention lends itself well to display on a conventional wall, office panels and in unusual settings such as in windows. Differently shaped objects, singly or in combination, can be used with eqivalent ease because of the absense of matting requirements.

Another aspect of the present invention is to provide a picture display device comprising a pair of panels having aligned, unpolished marginal edges which produce a thin, light scattering edge or border around the device to focus attention on the picture mounted therein. The device also includes a transparent, monofilament line which is adapted to hang the device on the wall. Because the frame panels are transparent, as is the support line, and the borders of the frame appear substantially unconnected with the picture, the picture and the border thereabout produce an attractive, mounted-in-space appearance. Being more or less invisible, the monofilament line can be hooked to a hanger at the top edge of a modern office room divider panel, eliminating the need to try to secure a fastener to the surface of the panel.

Yet another aspect of the present invention is to provide an inexpensive, attractive, versatile picture display device capable of a long useful life, and particularly well adapted for the proposed use.

These and many other important advantages of the invention will be further understood and appreciated by those skilled in the art by reference to the following written specification, claims, and appended drawings.

DETAILED DESCRIPTION OF THE PREFERRED EMBODIMENTS

Figure 1:
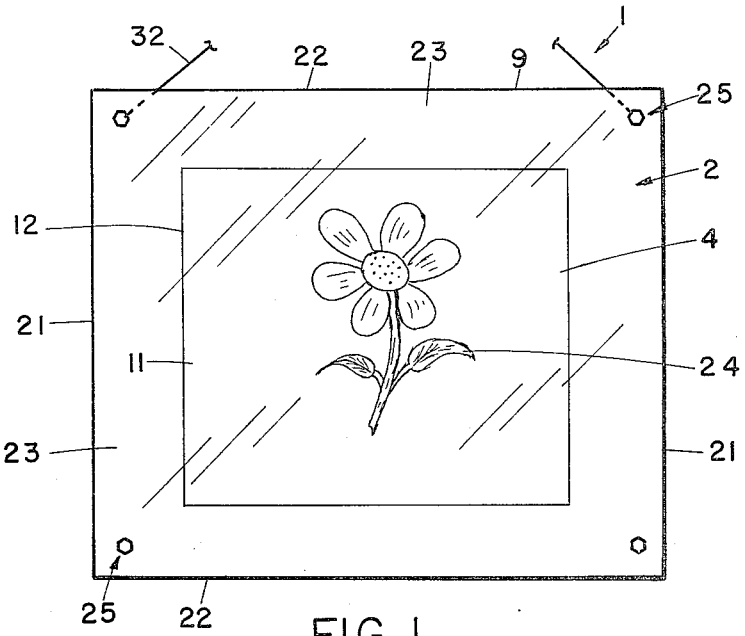
FIG. 1 is a front plan view of a picture display device embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 generally designates a picture display device embodying the present invention, comprising a front panel 2 and a rear panel 3 which are adapted to mount a picture 4, such as a drawing, photograph, painting, or the like, therebetween.

Figure 2:
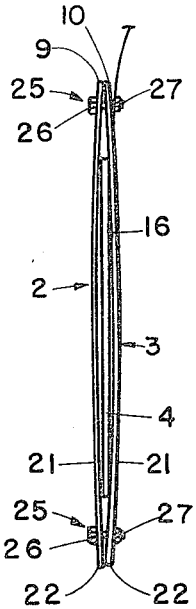
FIG. 2 is an end elevational view of the picture display device.
Figure 3:
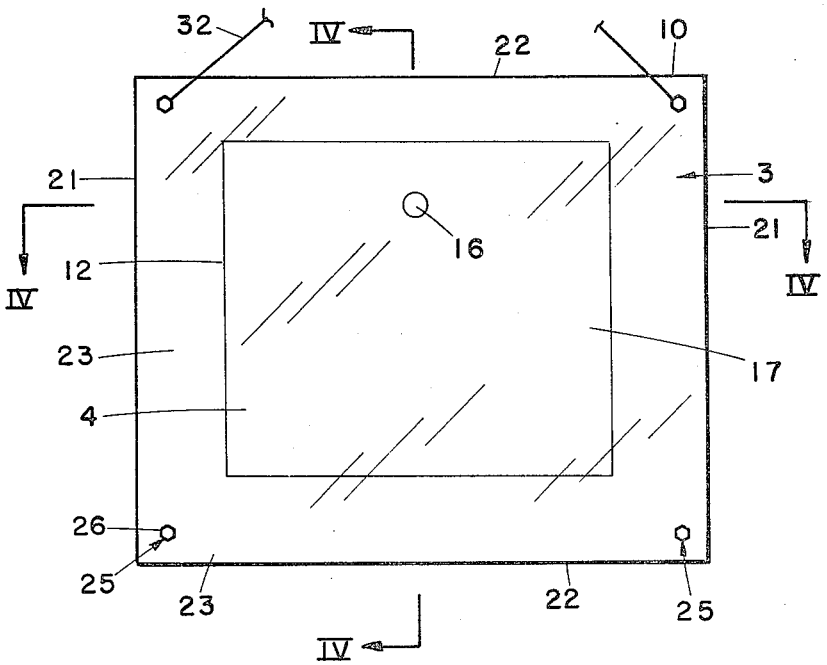
FIG. 3 is a rear plan view of the picture display device.

The front and rear panels 2 and 3 preferably have a substantially similar shape with substantially coextensive marginal edges 9 and 10 respectively. The front and rear panels 2 and 3 are adapted to assume an overlying relationship, as best illustrated in FIG. 2, for receiving the picture 4 therebetween. At least front panel 2 is transparent and adapted to overlie an image side 11 of the picture for viewing the picture 4 therethrough. The term transparent as used herein is intended to include a panel which is substantially transparent. Non-glare plastic is considered transparent herein. Rear panel 3 is preferably at least translucent, i.e. at least partly transparent. Both front and rear panels 2 and 3 are most preferably transparent, such that picture 4 stands out clearly from the background against which the device is hung, thereby imparting a perception of depth to the picture, in the nature of a three-dimensional picture or display. In the illustrated structure, both front and rear panels 2 and 3 are constructed of flat, planar sheets of a synthetic resin material, such as that sold under the trademark Plexiglas, such that the sheets are somewhat flexible and resilient, as well as relatively lightweight. The preferred thickness of panels 2 and 3 for average size frames is in the range of one-sixteenth to one-eighth of an inch.

The marginal edges 9 and 10 of front and rear panels 2 and 3 are preferably coextensive, and are of a shape which is larger than the marginal edge 12 of the picture 4 to achieve an attractive framing effect. In the illustrated structure, panels 2 and 3 as well as picture 4 have a rectangular shape. However, it is to be understood that panels 2 and 3 may assume virtually any desired shape, such as circular, oval, square, or the like. Similarly, the pictures can be of varying shapes.

The marginal edges 9 and 10 of each of panels 2 and 3 are preferably smooth, but unpolished, whereby when the device is exposed to light, the marginal edges produce a bright, light scattering, thin-lined border about the device, which appears substantially unconnected or disassociated with the picture 4. The edges 9 and 10 emit refracted and/or reflected light from their surface to create the thin, luminous border. The marginal edges 9 and 10 are substantially flat and oriented perpendicular to the associated faces of the panels, and the extreme corner edges are rounded slightly to remove sharp edges.

The illustrated display device 1 includes means for connecting picture 4 to one of panels 2 and 3, to retain the picture in a preselected orientation with respect to panel marginal edges 9 and 10. In the illustrated structure, a spot or dot of adhesive 16 is connected with rear panel 3 at an upper medial portion thereof, and is adapted to stick to the reverse side 17 of the picture 4 so as to retain the picture 4 squarely within the frame. The adhesive spot 16 is designed so that picture 4 may be removed from rear panel 3 without damaging the picture 4, yet retain sufficient adhesiveness to connect another picture therewith. Further, the adhesive dot 16 is preferably rather thin, so as to avoid undue interference with the convergence of front and rear panels 2 and 3 during assembly of the frame. Preferably, the dot is removable, as by peeling it off, so that different arrangements of pictures could be effected at different times. One might ship the device with several dots comprising pieces of double faced tape. The user could locate one or more of them where desired.

Figure 4:
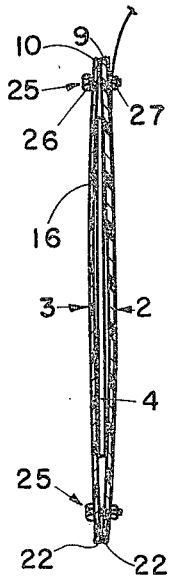
FIG. 4 is a vertical cross-sectional view of the picture display device, taken along the line IV—IV, FIG. 3.
Figure 5:
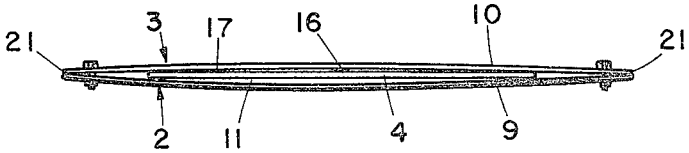
FIG. 5 is a side elevational view of the picture display device.

Means are provided for interconnecting front and rear panels 2 and 3 in an aligned relationship, wherein adjacent portions of marginal edges 9 and 10, specifically associated end and side edges 21 and 22, are disposed substantially coplanar. The connecting means retains the panels in an assembled position (FIGS. 1-5), whereby a variety of differently shaped pictures may be mounted therebetween without a separate mat. An attractive ornamental border 23 is simultaneously formed about picture 4 to focus attention on the image 24. In this example, threaded fasteners 25 extend through apertures formed in each corner of front and rear panels 2 and 3, and converge the panels into an assembled condition, wherein the panels abut the opposite sides 11 and 17 of picture 4 and compressingly retain the picture therebetween in a flat condition. The illustrated fasteners 25 include threaded bolts having the heads 26 thereof disposed on the outer surface of front panel 2, and nuts 27 engaging the free end of fasteners 25 and abutting the outside surface of rear panel 3 in the assembled position. These might be made of metal or molded of clear plastic themselves. In the arrangement illustrated in FIGS. 2, 4 and 5, when fasteners 25 are fully tightened, the associated end portions of the panels 2 and 3 are typically converged into an abutting relationship, and the medial portions of the panels are bowed slightly outwardly to accommodate the picture 4 which is interposed therebetween. The bowing between panels 2 and 3 is shown greatly exaggerated in FIGS. 2, 4 and 5 for illustrative purposes. When panels 2 and 3 are fully converged, the greatest distance between the panels is normally in the range of 1/32-⅛ inches. In general, the thickness of picture 4 and the stiffness of panels 2 and 3 will determine how closely together the end portions of the panels are converged. The tightening of fasteners 25 draws front and rear panels 2 and 3 together, thereby retaining the picture in a flat, sandwiched condition between the panels, as well as resiliently compressing or constricting picture 4 therebetween. The compressing forces of panels 2 and 3 on picture 4, in conjunction with adhesive dot 16 forms a dual retention arrangement which prevents picture 4 from either translating or pivoting from its centered position between the panels. In this example, marginal edges 9 and 10 of front and rear panels 2 and 3 are abuttingly converged at the corners of the panels, and are spaced slightly apart at the medial portions of the panels.

It is to be understood that the present invention contemplates connecting picture 4 between panels 2 and 3 either by adhesive spot 16 alone, or by the abutting convergence of panels 2 and 3 against the picture alone, as well as by the dual retention arrangement of both of these fastening means as is shown and described herein.

A flexible line 32 is connected with one of panels 2 and 3, and is adapted for hanging the picture display device 1 on a wall. The illustrated line 32 is a transparent, monofilament fiber, constructed of a synthetic resin material, which is substantially invisible when supporting the device 1, whereby the picture 4 and luminescent line border thereabout appear to be mounted free-in-space. Flexible line 32 comprises a single piece of cord having the free ends thereof wrapped or convoluted about the upper pair of fasteners 25 at the rear side thereof, between the rear panel 3 and the nut 27.

In use, a picture 4 is mounted in a disassembled display device 1 by first selecting a frame which is larger than the picture 4 to be framed, and preferably has a shape which is geometrically similar to that of the picture 4. In the illustrated example, the picture 4 is rectangular in shape, with the longitudinal axis thereof extending in a substantially horizontal plane, and a frame 1 is chosen with similarly shaped front and rear panels 2 and 3, such that the side and end edges 22 and 21 of frame panels 2 and 3 are substantially parallel with corresponding side and end edges of picture 4.

The device 1 is particularly adapted for mounting borderless pictures. Hence, picture 4 is preferably borderless to the extent that it does not include a separate border which contrasts with the background of the picture. In other words, the image pattern in the picture should extend completely out to the edges of the picture. If the selected picture 4 is not borderless, it may be trimmed to remove any existing border prior to mounting in the device. It is the shape of the final, trimmed border of the picture 4 which should be matched with the shape of the device 1.

The picture 4 is then mounted in the disassembled frame by centering picture 4 on rear panel 3, and then applying slight pressure over the upper surface of the picture to insure adherence of the rear side 17 of the picture with adhesive spot 16. This adhesive connection retains the picture 4 in the preselected centered orientation in the frame at least while the panels are being assembled. The front panel 2 is then placed over rear panel 3, with marginal edges 9 and 10 thereof positioned in a coplanar relationship, whereby the fastener apertures in the corners of the panels are aligned and coaxial. Fasteners 25 are then inserted through each of the associated fastener apertures, in a manner whereby the heads 26 of the bolts conceal the fastener apertures. The free ends of flexible line 32 are then wrapped around the upper fasteners 25, and nuts 27 are then threadedly engaged over the free end of each of the fasteners and are tightened down against the back surface of the rear panel 3, thereby converging the front and rear panels, and simultaneously sandwiching or clamping picture 4 therebetween.

The assembled picture display device is particularly adapted for decorating removable office walls and/or dividers. In this application, line 32 is extended over the top of the divider and connected therewith by a suitable clamp, whereby the device is suspended in a manner which does not require any fastener or hanger on the face of the wall. In a similar manner, the device 1 may be hung from the cove molding or other similar fastening strip portion of a conventional building wall. In any event, it is preferred that the device be supported in a manner which avoids using a conventional hook-type of picture hanger fastened to the building wall adjacent the device. If a wall mounted picture hanger must be used, it is preferred that the same be as small and inconspicuous as possible, so as not to appreciably detract from the device's free-in-space appearance. In the alternative, a hanger could be secured to the back of back panels 3 as a substitute for the monofilament line. A picture could readily be located over this portion of the back panel so that hanger could not be seen. When both panels 2 and 3 of the device are transparent, a mar-free portion of the wall or mounting panel is preferably chosen on which to hang the device, since the border 23 will assume substantially the appearance of the background.

In any application, the presence of the picture 4 between front and rear panels 2 and 3 creates an attractive frame or border 23 about the picture. The inside edge of border 23 is defined by the marginal edge of picture 4, and the outside edge of the border is defined by marginal edges 9 and 10 of rear and front panels 2 and 3. When the device is exposed to light, either natural or aritificial, the unpolished marginal edges 9 and 10 produce a light scattering line thereabout in the nature of a thin line-shaped border. Because the panels are otherwise transparent, the visible perception of the border is that the same is unconnected or disassociated with the frame, and is somehow disposed freely in space about picture 4. The texture or appearance of border 23 assumes that of the background against which the device is hung, such as the partition or wall.

A variety of differently sized pictures 4 may be attractively mounted in the same device 1 by simply disassembling front and rear panels 2 and 3 through reversing the above-explained steps. After the old picture 4 has been removed, the new picture is centered on the rear panel and the device is reassembled. Because rear and front panels 2 and 3 are transparent, differently sized pictures may be attractively and neatly mounted in the same frame without requiring a separate mat. The two panels 2 and 3 form a transparent or see-through matting which automatically sizes itself to the shape of the picture mounted therein. The fasteners converge the resilient panels 2 and 3 against the picture 4, in a manner whereby the panels automatically conform to the thickness and size of the picture 4, and hold the picture tightly therebetween without excessive pressure. Although any shape of picture may be mounted within the device 1, it is preferred that the shape of picture be matched geometrically similarly with the shape of the front and rear panels 2 and 3.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A picture display device, comprising:

first and second panels having a substantially similar shape with substantially coextensive marginal edges; said panels being adapted to assume an overlying relationship in an assembled condition for receiving a picture therebetween; at least one of said panels being transparent, and adapted to overlie an image side of said picture for viewing the picture therethrough, the other being at least translucent;

means for interconnecting said first and second panels in an aligned relationship, wherein adjacent portions of said marginal edges are disposed substantially coplanar, and retaining said panels in the assembled position for mounting a variety of differently shaped pictures therebetween without a separate mat, and simultaneously forming an attractive ornamental border about said picture to focus attention on the image; and wherein said marginal edges are unpolished, whereby when said device is exposed to light, said marginal edges produce a light scattering line border about said device which appears substantially unconnected with the picture.

2. A picture display device as set forth in claim 1, including:

a flexible line connected with one of said panels for hanging said device on a wall; said line being a transparent, monofilament fiber which is substantially invisible when supporting said device, whereby said picture and said light scattering line border thereabout appear to be mounted free-in-space.

3. In combination, a picture and a display device therefor, comprising:

first and second panels having a substantially similar shape with substantially coextensive marginal edges; said panels assuming an overlying relationship in an assembled condition, and receiving said picture therebetween;

each of said panels being transparent and forming a transparent mat, whereby said picture stands out from the background against which said device is hung, and imparts a perception of depth in that the picture appears to float out to a point spaced from the background;

means for interconnecting said first and second panels in an aligned relationship, wherein adjacent portions of said marginal edges are free and disposed substantially coplanar, and retaining said panels in the assembled position for mounting a variety of differently shaped pictures therebetween without a separate mat, and simultaneously forming an attractive ornamental border about said picture to focus attention on the same; and wherein said picture is borderless, and has a shape geometrically similar to said panels; and said marginal edges are unpolished, whereby when said device is exposed to light, said marginal edges produce a light scattering line border about said device which appears substantially unconnected with said picture.

* * * * *